US011369147B2

(12) United States Patent
Lin et al.

(10) Patent No.: US 11,369,147 B2
(45) Date of Patent: Jun. 28, 2022

(54) ELECTRONIC CIGARETTE ATOMIZER EMPLOYING ULTRASONIC ATOMIZING UNIT

(71) Applicant: Guangrong Lin, Guangdong (CN)

(72) Inventors: Guangrong Lin, Guangdong (CN); Xianbin Zheng, Guangdong (CN)

(73) Assignee: Guangrong Lin, Shenzhen (CN)

( * ) Notice: Subject to any disclaimer, the term of this patent is extended or adjusted under 35 U.S.C. 154(b) by 849 days.

(21) Appl. No.: 16/322,245

(22) PCT Filed: Jun. 15, 2017

(86) PCT No.: PCT/CN2017/088464

§ 371 (c)(1),
(2) Date: Jan. 31, 2019

(87) PCT Pub. No.: WO2018/001105

PCT Pub. Date: Jan. 4, 2018

(65) Prior Publication Data

US 2019/0191781 A1 Jun. 27, 2019

(30) Foreign Application Priority Data

Jul. 1, 2016 (CN) ..... 201610518211.3

(51) Int. Cl.
*A24F 40/46* (2020.01)
*A24F 40/05* (2020.01)
(Continued)

(52) U.S. Cl.
CPC ..... *A24F 40/46* (2020.01); *A24F 40/05* (2020.01); *A24F 40/42* (2020.01); *A24F 40/44* (2020.01);
(Continued)

(58) Field of Classification Search
CPC ..... A24F 40/46; A24F 40/05; A24F 40/42; A24F 40/44; A24F 40/10; A24F 40/45; A24F 40/485; B05B 17/0607; H05B 3/00
See application file for complete search history.

(56) References Cited

U.S. PATENT DOCUMENTS

2020/0154788 A1* 5/2020 Novak, III ..... G05B 15/02
2021/0077751 A1* 3/2021 Hua ..... A61M 15/0085
2021/0337879 A1* 11/2021 Qiu ..... A24F 40/42

FOREIGN PATENT DOCUMENTS

CN 203662023 U 6/2014
CN 104271255 A 1/2015
(Continued)

OTHER PUBLICATIONS

International Search Report of PCT Patent Application No. PCT/CN2017/088464 dated Aug. 30, 2017.

*Primary Examiner* — Travis S Chambers

(57) ABSTRACT

An electronic cigarette atomizer employing an ultrasonic atomizing unit (6), which comprises an outer tube (1), a liquid storage cup (2), a porous supporting sheet (3), a cigarette liquid permeation sheet (4), an ultrasonic atomizing unit (6), an atomizing seat (7), and a power connector (8). An inside of the atomizing seat (7) is provided with the ultrasonic atomizing unit (6), which includes a liquid guiding stick (61), an atomizing sheet (62), and an ultrasonic oscillating sheet (63); the ultrasonic oscillating sheet (63) can ultrasonically atomize the cigarette liquid conducted from the cigarette liquid permeation sheet (4) and the liquid guiding stick (61) to the atomizing sheet (62). The ultrasonic atomizing unit (6) is employed to atomize the cigarette liquid, which prevents the burning and deformation of the components of the electronic cigarette atomizer due to heating at high temperature.

10 Claims, 7 Drawing Sheets

(51) Int. Cl.

| | |
|---|---|
| ***A24F 40/42*** | (2020.01) |
| ***A24F 40/44*** | (2020.01) |
| ***B05B 17/06*** | (2006.01) |
| ***H05B 3/00*** | (2006.01) |
| *A24F 40/10* | (2020.01) |
| *A24F 40/485* | (2020.01) |

(52) U.S. Cl.
CPC ..... *B05B 17/0607* (2013.01); *H05B 3/00* (2013.01); *A24F 40/10* (2020.01); *A24F 40/485* (2020.01)

(56) References Cited

FOREIGN PATENT DOCUMENTS

| | | | |
|---|---|---|---|
| CN | 204180937 | U | 3/2015 |
| CN | 105266206 | A | 1/2016 |
| CN | 105559151 | A | 5/2016 |
| CN | 205947122 | U | 2/2017 |
| CN | 206137193 | U | 5/2017 |

* cited by examiner

ELECTRONIC CIGARETTE ATOMIZER EMPLOYING ULTRASONIC ATOMIZING UNIT

FIELD OF THE INVENTION

The present invention relates to the technical field of electronic cigarettes and particularly relates to an electronic cigarette atomizer employing an ultrasonic atomizing unit.

BACKGROUND OF THE INVENTION

In traditional cigarette, tar is produced with the burning of tobacco, which is easily inhaled during smoking, posing significant health hazards. Electronic cigarettes produce smoke by atomizing a cigarette liquid with an atomizing unit. As the electronic cigarette liquid does not contain any tar, electronic cigarettes are gradually used as a replacement for traditional cigarettes.

In an existing electronic cigarette atomizer, in order to atomize the electronic cigarette liquid to smokable electronic cigarette smoke, the electric cigarette liquid is usually heated and atomized by an electric heating wire. As the electric heating wire needs to emit a large amount of heat for atomization, the atomizing unit generates a high temperature during heating and atomization. When in frequent use, the high temperature of the atomizing unit may easily cause the burning and deformation of the liquid guiding rope and the atomizing seat. As a result, a malfunction the atomizing unit is likely to occur. In addition, a burnt odor is produced due to the high-temperature burning of the liquid guiding rope and the atomizing seat. This will damage the taste of the cigarette and lead to unfavorable user experience.

SUMMARY OF THE INVENTION

The objective of the present invention is to provide an electronic cigarette atomizer employing an ultrasonic atomizing unit. The electronic cigarette atomizer employs an ultrasonic atomizing unit to atomize an electronic cigarette liquid by ultrasonic vibration.

The objective of the present invention is achieved by the following technical solution: the electronic cigarette atomizer employing an ultrasonic atomizing unit, wherein it comprises an outer tube which is provided with a mouthpiece at its upper end and an opening at its lower end; a liquid storage cup, a porous supporting sheet, a cigarette liquid permeation sheet, an ultrasonic atomizing unit, an atomizing seat, and a power connector are provided in the outer tube consecutively from top to bottom; the liquid storage cup is closed at its upper end and opened at its lower end; the cigarette liquid permeation sheet is closely adhered to a lower surface of the porous supporting sheet; the atomizing seat is a tubular body with a vapor outlet provided at its side wall; an inside of the atomizing seat is provided with the ultrasonic atomizing unit, which includes a liquid guiding stick, an atomizing sheet, and an ultrasonic oscillating sheet; the liquid guiding stick connects with the cigarette liquid permeation sheet and the atomizing sheet; a cigarette liquid in the atomizing sheet can be ultrasonically atomized by the ultrasonic oscillating sheet; an upper-end surface of the atomizing seat presses a compression sheet tightly against the porous supporting sheet; a lower end of the atomizing seat is connected to the power connector; the power connector is sheathed in a lower end of the outer tube and rests against an inner wall of the outer tube.

Preferably, the inside of the atomizing seat is provided with a bottom wall, a center of the bottom wall is provided with an air inlet through hole; the bottom wall is provided with an air inlet groove in a direction from the air inlet through hole towards an opposite of the vapor outlet; the air inlet groove extends to an inner side wall of the atomizing seat.

Preferably, the ultrasonic oscillating sheet is disposed on an upper surface of the bottom wall; the atomizing sheet is provided on the ultrasonic oscillating sheet; the liquid guiding stick is disposed between the cigarette liquid permeation sheet and the atomizing sheet; the liquid guiding stick presses against and connect with the liquid permeation sheet and the atomizing sheet.

Preferably, the atomizing seat further includes an atomizing seat cover disposed at an upper end thereof; the atomizing seat cover is provided with a cover hole at a position corresponding to a position of the liquid guiding stick; the liquid guiding stick passes through the cover hole.

Preferably, a heating wire for warming is provided on the liquid guiding stick; when the heating wire is in operation, only an electronic cigarette liquid flowing through the liquid guiding stick is warmed.

Preferably, a heating wire for heating and atomization is provided on the liquid guiding stick; when the heating wire is in operation, part of an electronic cigarette liquid flowing through the liquid guiding stick is atomized.

Preferably, the porous supporting sheet is a hard sheet which is provided with a plurality of small through holes; an inner wall of the liquid storage cup at which upper and lower surfaces of the porous supporting sheet are positioned is provided with a protruding point or a protruding ring for clamping and fixing the porous supporting sheet.

Preferably, the compression sheet is provided between the cigarette liquid permeation sheet and an upper-end surface of the atomizing seat, the compression sheet is H-shaped and can be fit into an opening of the liquid storage cup; an upper side and a lower side of the compression sheet are convex arc segments, the lower side is provided with a vertical sheet-shaped projection.

Preferably, the cigarette liquid permeation sheet and the atomizing sheet are made from ceramic fiber; the liquid guiding stick is made from ceramic fiber, glass fiber or a hard porous ceramic material; the atomizing seat is made from a silicone material.

Preferably, a rectangular notch is provided at a side wall of a lower end of the liquid storage cup; an outer surface of the liquid storage cup is provided with a vapor groove in an axial direction and at a same circumferential position as the rectangular notch; the porous supporting sheet and the cigarette liquid permeation sheet are horizontally disposed at an inner wall of the liquid storage cup above the rectangular notch; a lower surface of the cigarette liquid permeation sheet levels with an upper edge of the rectangular notch; an upper end of the atomizing seat is inserted in the liquid storage cup and rests against an inner wall where the rectangular notch is positioned; the vapor outlet of the atomizing seat overlaps with the rectangular notch of the liquid storage cup.

The electronic cigarette atomizer of the present invention employs an ultrasonic atomizing unit to atomize an electronic cigarette liquid by ultrasonic vibration. The ultrasonic atomizing unit does not need to heat the electronic cigarette liquid during its operation, preventing the burning and deformation of the components of the electronic cigarette atomizer including the liquid guiding rope and the atomizing seat. Any malfunction of the atomizer due to high temperature as a result of frequent smoking is prevented; the production of a burnt odor due to high-temperature burning is also prevented. As a result, the taste of the cigarette is improved, which leads to favorable user experience.

DETAILED DESCRIPTION OF THE ILLUSTRATED EMBODIMENTS

Best Mode for Carrying Out the Present Invention

The present invention will be further described hereafter with reference to the embodiments and accompanying drawings.

Figure 1:
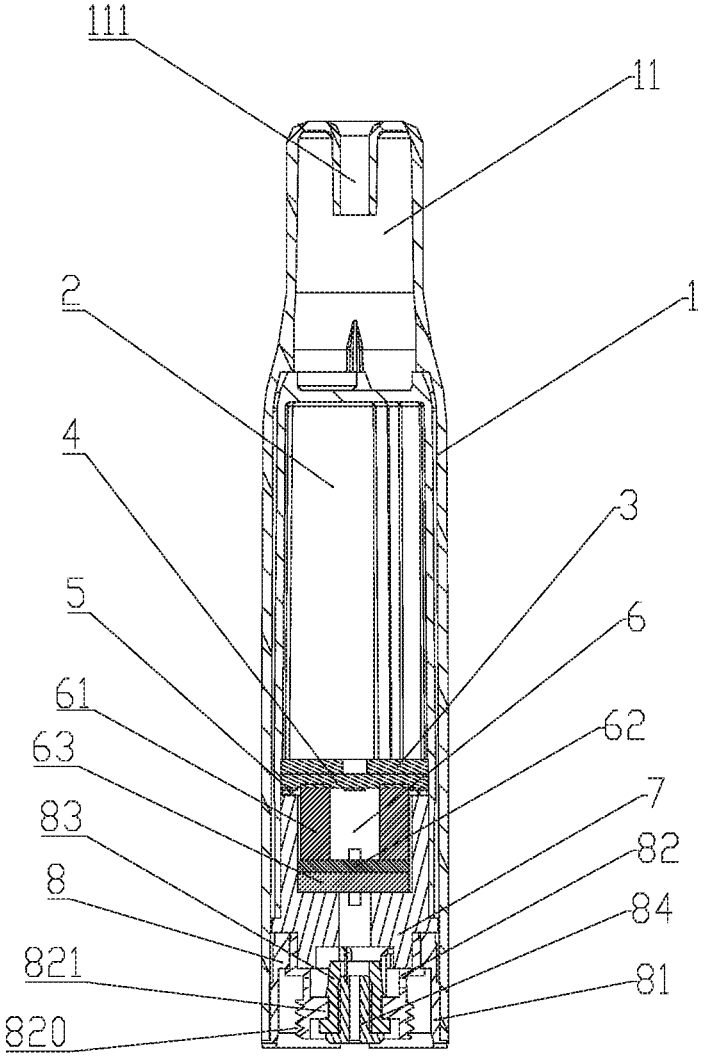
FIG. 1 is a cross-sectional view of embodiment 1 of the present invention.

The present invention relates to an electronic cigarette atomizer that employs an ultrasonic atomizing unit. For the convenience of the following description, the electronic cigarette atomizer is placed vertically with its suction hole facing upwards (as shown in FIG. 1). The terms "upper end", "lower end" are used to describe the up/down directions and positional relationships of the components when the electronic cigarette atomizer is placed vertically.

Figure 2:
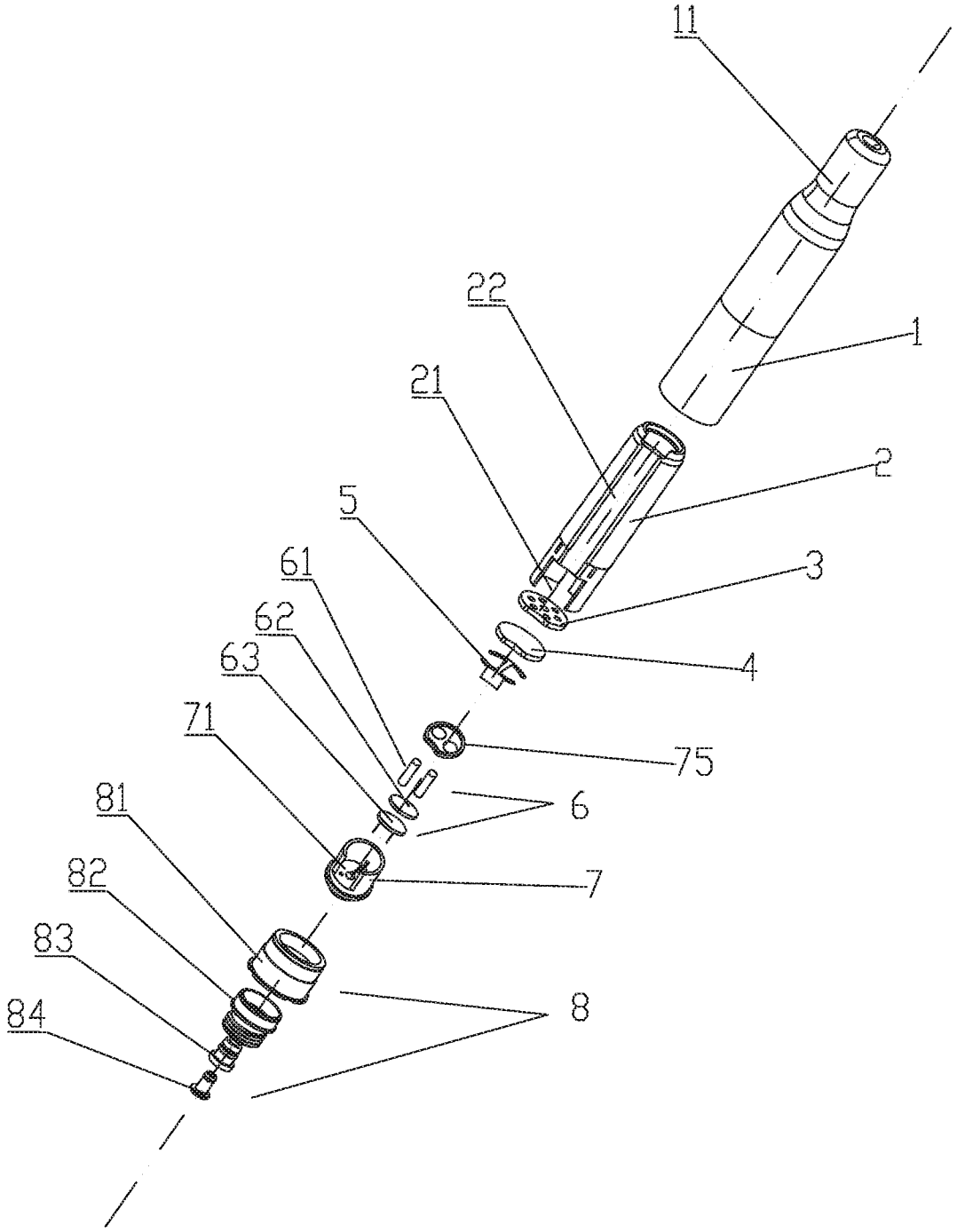
FIG. 2 is an exploded view of embodiment 1 of the present invention.

As shown in FIG. 1 and FIG. 2, the electronic cigarette atomizer employing an ultrasonic atomizing unit of the embodiment of the present invention comprises an outer tube 1 which is provided with a mouthpiece 11 at its upper end and an opening at its lower end; a liquid storage cup 2, a porous supporting sheet 3, a cigarette liquid permeation sheet 4, a compression sheet 5, an ultrasonic atomizing unit 6, an atomizing seat 7, and a power connector 8 are provided in the outer tube 1 consecutively from top to bottom. The upper-end surface of the atomizing seat 7 is closely attached to the compression sheet 5 to press the cigarette liquid permeation sheet 4 against the porous supporting sheet 3. The lower end of the atomizing seat 7 is connected to the power connector 8; the power connector is sheathed in the lower end of the outer tube 1 and rests against an inner wall of the outer tube 1.

Figure 3:
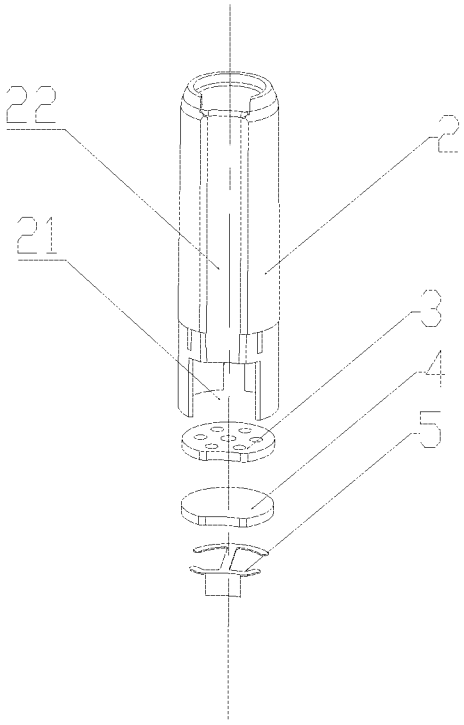
FIG. 3 is a perspective structural diagram of a liquid storage cup according to the embodiments of the present invention.

As shown in FIGS. 1, 2, and 3, the liquid storage cup 2 is closed at its upper end and opened at its lower end; the liquid storage cup 2 is used to store the electronic cigarette liquid. The porous supporting sheet 3 is horizontally fixed to the inner wall of the opening at the lower end of the liquid storage cup 2. The porous supporting sheet 3 is a hard sheet which is provided with a plurality of small through holes; the inner wall of the liquid storage cup at which the upper and lower surfaces of the porous supporting sheet 3 are positioned is provided with a protruding point or a protruding ring (not shown in drawings) for clamping and fixing the porous supporting sheet 3. The porous supporting sheet 3 is provided with a plurality of small through holes for the electronic cigarette liquid to slowly flow out from the liquid storage cup 2. The porous supporting sheet 3 also serves to fix and support the cigarette liquid permeation sheet 4. The cigarette liquid permeation sheet 4 is closely adhered to the porous supporting sheet 3 and is generally made from a porous material which allows slow permeation. When the user is smoking, negative pressure is created in the atomizing seat 7, which draws the electronic cigarette liquid contained in the liquid storage cup 2 out, permeating through the cigarette liquid permeation sheet 4. When the user is not smoking, the pressure inside and outside the liquid storage cup 2 is balanced, the cigarette liquid permeation sheet 4 prevents the cigarette liquid from leaking out of the liquid storage cup 2.

As shown in FIGS. 1, 2, and 3, the liquid storage cup 2 is provided with a rectangular notch 21 at the side wall of its lower end; the outer surface of the liquid storage cup 2 is provided with a vapor groove 22 in the axial direction and at the same circumferential position as the rectangular notch 21. The porous supporting sheet 3 and the cigarette liquid permeation sheet 4 are horizontally disposed at the inner wall of the liquid storage cup 2, above the rectangular notch 21. The lower surface of the cigarette liquid permeation sheet 4 levels with the upper edge of the rectangular notch 21. The upper end of the atomizing seat 7 is inserted in the liquid storage cup 2 and rests against an inner wall where the rectangular notch 21 is positioned; and the vapor outlet of the atomizing seat 7 overlaps with the rectangular notch 21 of the liquid storage cup 2, so that the electronic cigarette smoke produced by the ultrasonic atomizing unit 6 can be discharged through a vapor outlet 71 (rectangular notch 21). The vapor then passes a vapor discharge channel enclosed by the vapor groove 22 and the inner wall of the outer tube 1 and finally flows out into the user's mouth through the suction hole 111 of the mouthpiece 11.

Figure 4:
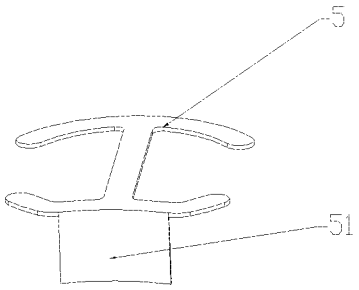
FIG. 4 is a structural diagram of a compression sheet according to the embodiments of the present invention.

As shown in FIGS. 1, 3 and 4, the compression sheet 5 is H-shaped and can be fit into the opening at the lower end of the liquid storage cup 2. The upper and lower sides of the compression sheet 5 are convex arc segments, and the lower side is provided with a vertical sheet-shaped projection 51. When the cigarette liquid permeation sheet 4 of the present invention fully absorbs the electronic cigarette liquid, the force of gravity increases. Under the action of gravity, the soft cigarette liquid permeation sheet 4 is prone to deviate from the porous supporting sheet 3 and loosen; as a result, the electronic cigarette liquid is very likely to leak from the liquid storage cup 2. In view of this, a compression sheet 5 is provided. The pressing of the upper-end surface of the atomizing seat 7 allows the compression sheet 5 to press the cigarette liquid permeation sheet 4 against the porous support piece 3. In this way, the cigarette liquid permeation piece 4 will not loosen, the electronic cigarette liquid is prevented from leaking out of the liquid storage cup 2. The compression sheet 5 of the present invention can be made from a thin stainless steel sheet to reduce its thickness and increase its rigidity.

Figure 5:
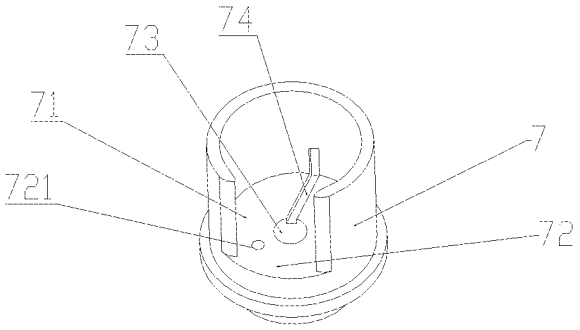
FIG. 5 is a perspective structural diagram of an atomizing seat according to the embodiments of the present invention.
Figure 6:
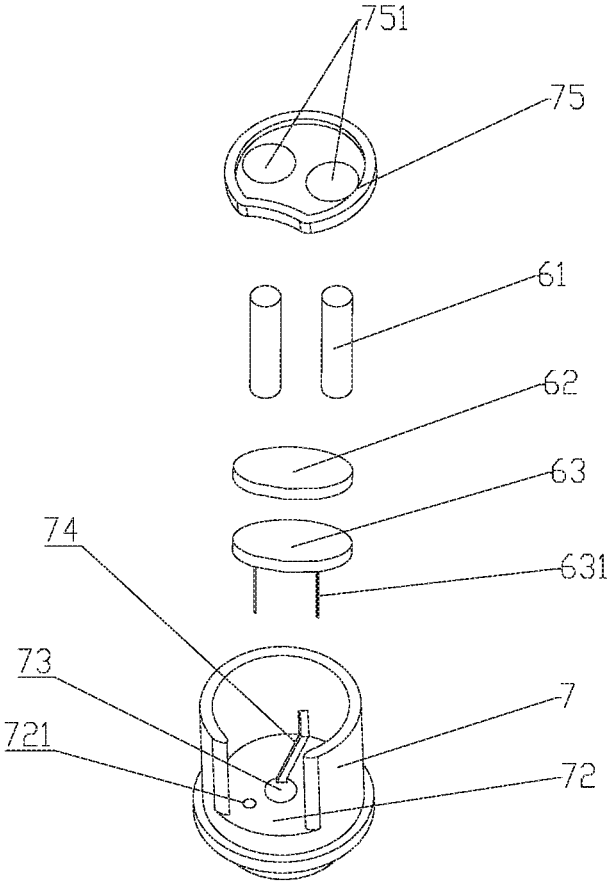
FIG. 6 is an exploded view of an atomizing seat assembled with an atomizing unit according to the embodiments of the present invention.
Figure 7:
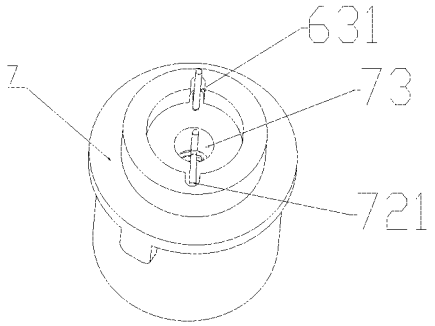
FIG. 7 is a perspective view of the bottom of an atomizing seat according to the embodiments of the present invention.

As shown in FIGS. 5, 6, and 7, the atomizing seat 7 is a tubular body with a vapor outlet 71 provided at its side wall. The inside of the atomizing seat 7 is provided with the ultrasonic atomizing unit 6. The ultrasonic atomizing unit 6 includes a liquid guiding stick 61, an atomizing sheet 62 and an ultrasonic oscillating sheet 63. The two ends of the liquid guiding stick 61 are respectively connected with the cigarette liquid permeation sheet 4 and the atomizing sheet 62. The electronic cigarette liquid conducted from the liquid permeation sheet 4 and the liquid guiding stick 5 to the atomizing sheet 62 can be ultrasonically atomized by the ultrasonic oscillating sheet 63. The inside of the atomizing seat 7 is provided with a bottom wall 72. The center of the bottom wall 72 is provided with an air inlet through hole 73. The bottom wall 72 is provided with an air inlet groove 74 in a direction from the air inlet through hole 73 towards the opposite of the vapor outlet 71; the air inlet groove 74 extends to the inner side wall of the atomizing seat 7. The bottom wall 72 of the atomizing seat 7 is further provided with a downward-extending wire inserting hole 721 for the two electrode leads 631 of the ultrasonic oscillating sheet 63 to pass through. The ultrasonic oscillating sheet 63 is disposed on the upper surface of the bottom wall 72; the atomizing sheet 62 is provided on the upper surface of the ultrasonic oscillating sheet 63. Two liquid guiding sticks 61 are disposed between the cigarette liquid permeation sheet 4 and the atomizing sheet 62; they press against and connect with the liquid permeation sheet 4 and the atomizing sheet 62. The liquid guiding sticks 61 serve to conduct the cigarette liquid in the liquid permeation sheet 4 to the atomizing sheet 62.

The cigarette liquid permeation sheet 4 and the atomizing sheet 62 of the present invention are made from ceramic fiber. The liquid guiding stick 61 is made from ceramic fiber, glass fiber or a hard porous ceramic material for better absorption, conduction and storage of the electronic cigarette liquid. The atomizing seat 7 is made from a silicone material; the soft silicone material acts to absorb shock and seal.

As shown in FIGS. 5 and 6, the atomizing seat 7 further includes an atomizing seat cover 75 disposed at an upper end thereof. The atomizing seat cover 75 is provided with a cover hole 751 at a position corresponding to the position of the liquid guiding stick 61. The liquid guiding stick 61 passes through the cover hole 751. The atomizing seat cover 75 is used for positioning and fixing the liquid guiding stick 61 and for preventing the atomizing seat 7 from deformation.

Figure 8:
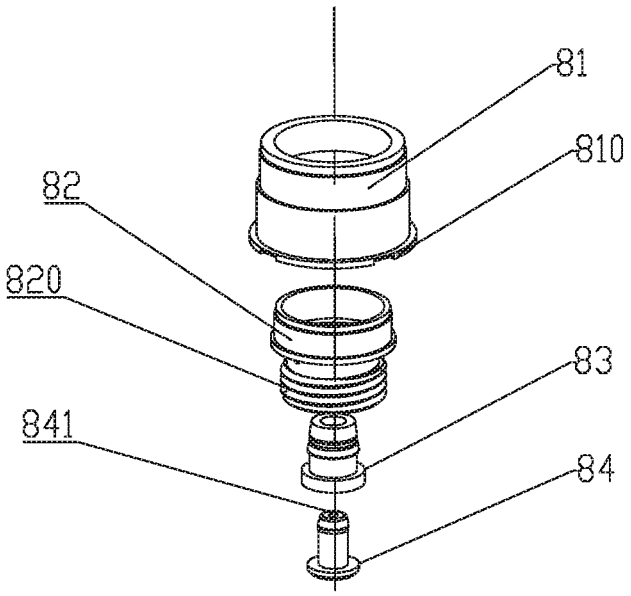
FIG. 8 is an exploded view of a power connector according to the embodiments of the present invention.

As shown in FIG. 1 and FIG. 8, the power connector 8 includes a tube body 81 provided with an annular shoulder 810 at one end; an electrode holder 82 is sheathed in the other end of the tube body 81 and rests against an inner wall of the tube body 81. The outer surface of the electrode holder 82 is provided with a thread 820, the inside of the electrode holder 82 is provided with a radial blocking ring 821. An insulating holder 83 is inserted into a central through hole of the radial blocking ring 821. A nail electrode 84 is inserted into the insulating holder 83, the nail electrode 84 is provided with an electrode through hole 841 at a center thereof. The two electrodes of the ultrasonic oscillating sheet 63 are electrically connected to the nail electrode 84 and the electrode holder 82 respectively and are further electrically connected to the positive and negative electrodes of an electronic cigarette power source.

As shown in FIGS. 1, 3, 6 and 8, in the embodiment of the present invention, when the atomizer is operating, the electronic cigarette liquid contained in the liquid storage cup 2 flows out through the small through holes of the porous supporting sheet 3 to the cigarette liquid permeation sheet 4. When the cigarette liquid permeation sheet 4 fully absorbs the cigarette liquid, the cigarette liquid can be conducted to the liquid guiding stick 61, and then transferred to the atomizing sheet 62 via the liquid guiding stick 61. The electronic cigarette liquid absorbed by the atomizing sheet 62 is atomized by the electrically-powered ultrasonic oscillating piece 63. At this point, the outside air flows in from the electrode through hole 841 of the nail electrode 84, passes through the air inlet through hole 73, the air inlet groove 74, ultimately flows into an atomization space inside the atomizing seat 7 and above the atomizing sheet 62. The vapor then passes through a vapor discharge channel enclosed by the vapor groove 22 and the inner wall of outer tube 1 and finally flows into the user's mouth through a suction hole 111 of the mouthpiece 11.

Embodiment 2

On the basis of the first embodiment described above, the atomization unit is modified: a heating wire for warming is provided on the liquid guiding stick; the other structures remain the same.

Figure 9:
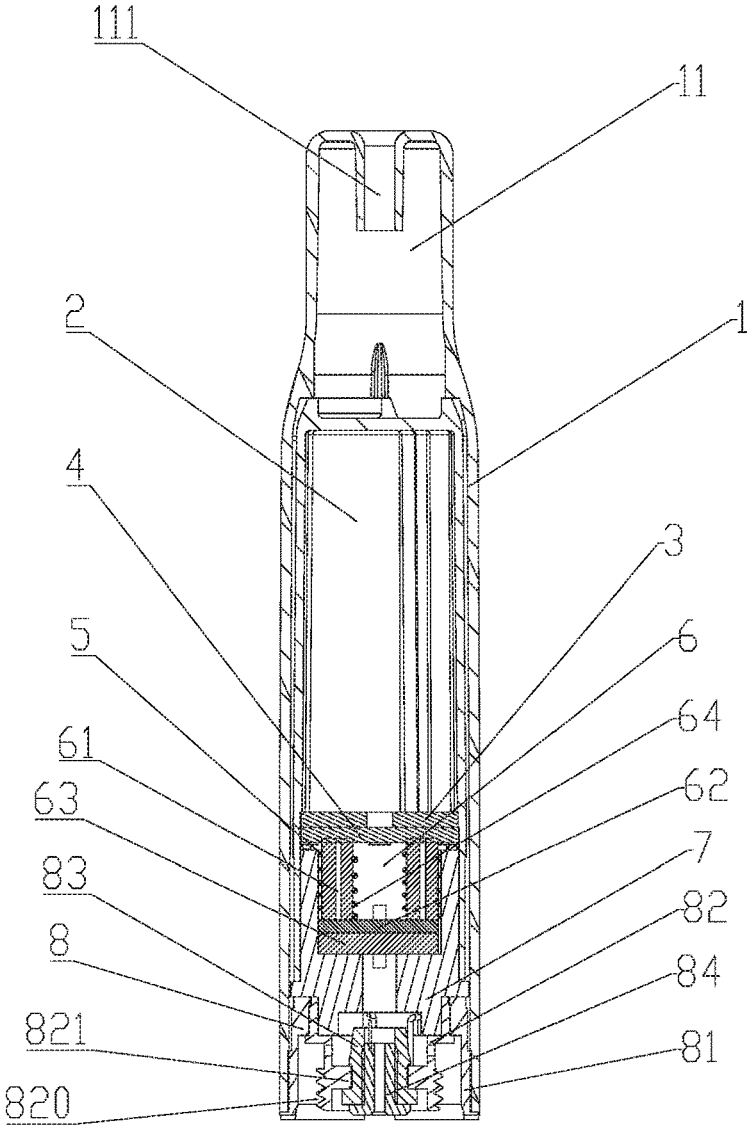
FIG. 9 is a cross-sectional view of embodiment 2 of the present invention.

As shown in FIG. 9, a heating wire 64 for warming is provided on the liquid guiding stick 61. When the heating wire 64 is in operation, only the electronic cigarette liquid flowing through the liquid guiding stick is warmed. Different types of electronic cigarette liquids have different viscosities; a high viscosity may lead to decreased atomization effect of the ultrasonic oscillating sheet 63 on the electronic cigarette liquid. Therefore, the liquid guiding stick 61 is provided with the heating wire 64 for warming the electronic cigarette liquid flowing through the liquid guiding stick 61. When the electronic cigarette liquid is transferred to the atomizing sheet 62, the atomizing effect of the ultrasonic vibration sheet 63 on the electronic cigarette liquid can be improved because the viscosity of the electronic cigarette liquid has been lowered. As the heating wire 64 of embodiment 2 is only used for warming, it may be relatively fine and short; in addition, the electric current flowing through should be low. The electronic cigarette liquid is not atomized when the heating wire 64 performs warming.

Figure 10:
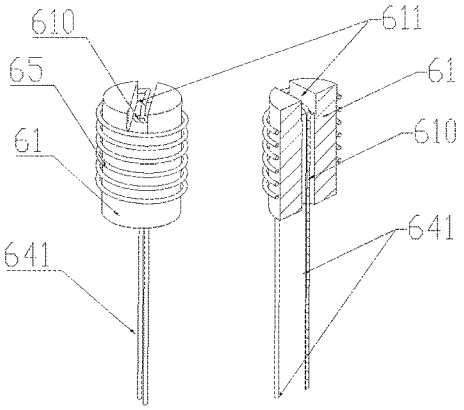
FIG. 10 is a perspective structural view and a cross-sectional view of a liquid guiding stick assembled with an electric heating wire according to embodiment 2 of the present invention.

As shown in FIG. 10, the liquid guiding stick 61 of the present embodiment is cylindrically shaped and is made from a porous and permeable ceramic material; the heating wire 64 winds around the outside of the liquid guiding stick 61. The two ends of the heating wire 62 are connected with a lead wire 641. A liquid guiding through hole 610 is provided at the central axis of the liquid guiding stick 61. A liquid guiding groove 611 is provided along the diameter of the upper-end surface of the liquid guiding stick 61. The heating wire 64 winds around the outer wall of the liquid guiding stick 61. The lead wire 641 which is connected to the upper end of the heating wire 64 is disposed in the liquid guiding groove 611 and is led downwards through the liquid guiding through hole 610. The other lead wire 641 is led downwards along the outer wall of the liquid guiding stick 61.

Embodiment 3

In embodiment 3, on the basis of the first embodiment described above, the atomization unit is modified: a heating wire for heating and atomization is provided on the liquid guiding stick; the other structures remain the same.

Figure 11:
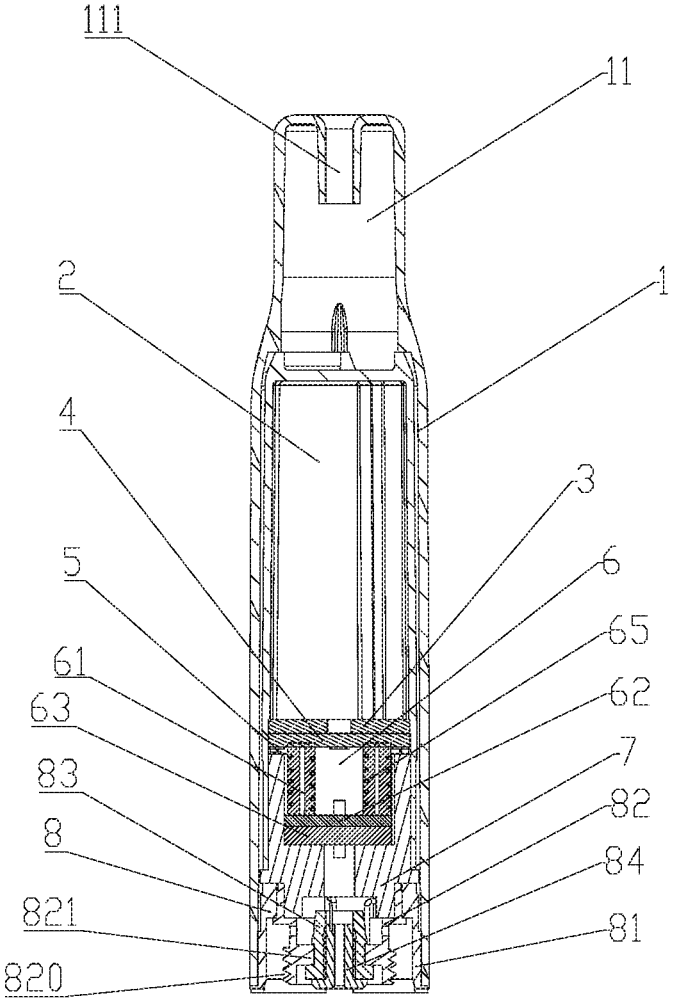
FIG. 11 is a cross-sectional view of embodiment 3 of the present invention.

As shown in FIG. 11, a heating wire 65 for heating and atomization is provided on the liquid guiding stick 61. When the heating wire 65 is in operation, part of the electronic cigarette liquid flowing through the liquid guiding stick 61 is atomized, and the other part of the electronic cigarette is transferred to the atomizing sheet 62 to be atomized by the ultrasonic oscillating sheet 63. In the present embodiment 3, the heating wire 65 and the ultrasonic oscillating sheet 63 are simultaneously operated during smoking, so that the amount of smoke generated during smoking can be significantly increased, improving the user experience. What is different from embodiment 2 is that the heating wire 65 in embodiment 3 is used for heating and atomization; therefore, the heating wire should be relatively thick and long; in addition, the electric current flowing through should be high. Part of the electronic cigarette liquid is atomized when the heating wire 64 performs heating.

Figure 12:
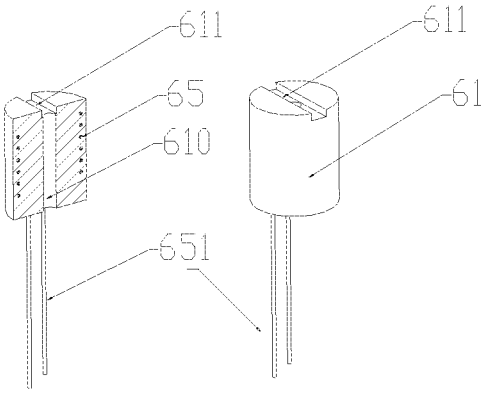
FIG. 12 is a perspective structural view and a cross-sectional view of a liquid guiding stick assembled with an electric heating wire according to embodiment 3 of the present invention.

As shown in FIG. 12, the liquid guiding stick 61 of the present embodiment is cylindrically shaped and is made from a porous and permeable ceramic material. A liquid guiding groove 611 is provided along the diameter of the upper-end surface of the liquid guiding stick 61. The heating wire 65 winds around the inside of the liquid guiding stick 61 and is fused integrally therewith. The lead wire 651 of the heating wire 65 projects out of the liquid guiding stick 61 and is led downwards. The liquid guiding through hole 610 and the liquid guiding groove 611 can be ventilated and can better conduct the smoke liquid.

The aforementioned embodiments are only the preferred embodiments of the present invention. All equivalent changes and modifications made within the scope of the claims of the present invention should fall within the scope of protection of the claims of the present invention.

What is claimed is:

1. An electronic cigarette atomizer employing an ultrasonic atomizing unit, wherein it comprises an outer tube which is provided with a mouthpiece at its upper end and an opening at its lower end; a liquid storage cup, a porous supporting sheet, a cigarette liquid permeation sheet, an ultrasonic atomizing unit, an atomizing seat, and a power connector are provided in the outer tube consecutively from top to bottom; the liquid storage cup is closed at its upper end and opened at its lower end; the cigarette liquid permeation sheet is closely adhered to a lower surface of the porous supporting sheet; the atomizing seat is a tubular body with a vapor outlet provided at its side wall; an inside of the atomizing seat is provided with the ultrasonic atomizing unit, which includes a liquid guiding stick, an atomizing sheet, and an ultrasonic oscillating sheet; the liquid guiding stick connects with the cigarette liquid permeation sheet and the atomizing sheet; a cigarette liquid in the atomizing sheet can be ultrasonically atomized by the ultrasonic oscillating sheet; an upper-end surface of the atomizing seat presses a compression sheet tightly against the porous supporting sheet; a lower end of the atomizing seat is connected to the power connector; the power connector is sheathed in a lower end of the outer tube and rests against an inner wall of the outer tube.

2. The electronic cigarette atomizer according to claim 1, wherein the atomizing seat further includes an atomizing seat cover disposed at an upper end thereof; the atomizing seat cover is provided with a cover hole at a position corresponding to a position of the liquid guiding stick; the liquid guiding stick passes through the cover hole.

3. The electronic cigarette atomizer according to claim 1, wherein a heating wire for warming is provided on the liquid guiding stick; when the heating wire is in operation, only an electronic cigarette liquid flowing through the liquid guiding stick is heated.

4. The electronic cigarette atomizer according to claim 1, wherein a heating wire for heating and atomization is provided on the liquid guiding stick; when the heating wire is in operation, part of an electronic cigarette liquid flowing through the liquid guiding stick is atomized.

5. The electronic cigarette atomizer according to claim 1, wherein the porous supporting sheet is a hard sheet which is provided with a plurality of small through holes; an inner wall of the liquid storage cup at which upper and lower surfaces of the porous supporting sheet are positioned is provided with a protruding point or a protruding ring for clamping and fixing the porous supporting sheet.

6. The electronic cigarette atomizer according to claim 1, wherein the compression sheet is provided between the cigarette liquid permeation sheet and an upper-end surface of the atomizing seat, the compression sheet is H-shaped and can be fit into an opening of the liquid storage cup; an upper side and a lower side of the compression sheet are convex arc segments, the lower side is provided with a vertical sheet-shaped projection.

7. The electronic cigarette atomizer according to claim 1, wherein the cigarette liquid permeation sheet and the atomizing sheet are made from ceramic fiber; the liquid guiding stick is made from ceramic fiber, glass fiber or a hard porous ceramic material; the atomizing seat is made from a silicone material.

8. The electronic cigarette atomizer according to claim 1, wherein a rectangular notch is provided at a side wall of a lower end of the liquid storage cup; an outer surface of the liquid storage cup is provided with a vapor groove in an axial direction and at a same circumferential position as the rectangular notch; the porous supporting sheet and the cigarette liquid permeation sheet are horizontally disposed at an inner wall of the liquid storage cup above the rectangular notch; a lower surface of the cigarette liquid permeation sheet levels with an upper edge of the rectangular notch; an upper end of the atomizing seat is inserted in the liquid storage cup and rests against an inner wall where the rectangular notch is positioned; the vapor outlet of the atomizing seat overlaps with the rectangular notch of the liquid storage cup.

9. The electronic cigarette atomizer according to claim 1, wherein the inside of the atomizing seat is provided with a bottom wall, a center of the bottom wall is provided with an air inlet through hole; the bottom wall is provided with an air inlet groove in a direction from the air inlet through hole towards an opposite of the vapor outlet; the air inlet groove extends to an inner side wall of the atomizing seat.

10. The electronic cigarette atomizer according to claim 9, wherein the ultrasonic oscillating sheet is disposed on an upper surface of the bottom wall; the atomizing sheet is provided on the ultrasonic oscillating sheet; the liquid guiding stick is disposed between the cigarette liquid permeation sheet and the atomizing sheet, the liquid guiding stick presses against and connect with the liquid permeation sheet and the atomizing sheet.

* * * * *